US011407088B2

(12) United States Patent
Gimondo et al.

(10) Patent No.: US 11,407,088 B2
(45) Date of Patent: Aug. 9, 2022

(54) MULTIFUNCTION SOCKET TOOL

(71) Applicant: Klein Tools, Inc., Lincolnshire, IL (US)

(72) Inventors: Jonathan T. M. Gimondo, Arlington Heights, IL (US); Scott M. Hargis, North Brook, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 110 days.

(21) Appl. No.: 16/845,276

(22) Filed: Apr. 10, 2020

(65) Prior Publication Data

US 2021/0316421 A1 Oct. 14, 2021

(51) Int. Cl.
*B25B 13/06* (2006.01)
*B25B 13/50* (2006.01)

(52) U.S. Cl.
CPC ..... *B25B 13/065* (2013.01); *B25B 13/5091* (2013.01)

(58) Field of Classification Search
None
See application file for complete search history.

(56) References Cited

U.S. PATENT DOCUMENTS 6,276,237 B1 * 8/2001 Stacy ..... B25B 13/488 81/13
6,715,384 B1 * 4/2004 Kozak ..... B25B 13/06 81/124.2
7,252,022 B1 * 8/2007 Losee ..... B25B 13/102 81/124.5
7,802,499 B2 * 9/2010 Stephens ..... B25B 13/065 81/125
9,221,155 B1 * 12/2015 Cantlon ..... B25B 23/065
2009/0151519 A1 * 6/2009 Monyem ..... B25B 13/06 81/124.4
2015/0151412 A1 * 6/2015 Chen ..... B25B 23/0035 81/124.5

* cited by examiner

*Primary Examiner* — David B. Thomas

(57) ABSTRACT

A multifunction socket tool is provided that has first socket component for engagement with a first size drive portion of a threaded fastener, and a second socket component for engagement with a second size drive portion of a threaded fastener, with the second size being smaller than the first size The second socket component translates from a first position where it can torque a drive portion of the second size to a second position where the first socket component can torque a drive portion of the first size. The first socket component includes a first pair of opposed slots for receiving and torqueing the eye of an eyebolt, and the second socket component includes a second pair of opposed slots for aligning the first pair of slots with the eye prior to engagement of the eye by the first pair slots.

20 Claims, 10 Drawing Sheets

MULTIFUNCTION SOCKET TOOL

CROSS-REFERENCE TO RELATED APPLICATIONS

None

BACKGROUND OF THE DISCLOSURE

The present disclosure relates sockets for transferring torque from a driver, such as a ratchet wrench, handled driver, or powered driver, to a fastener, such as a hexagonal nut, a bolt, or a screw. Such sockets are well known, particularly for driving fasteners including a hexagonal shaped drive portion, such as hex nuts, hex head bolts, and hex head screws, but there is a continuing need for improvement, including a continuing need to increase the functionality of such sockets. In this regard, eyebolts, wing nuts, and ring nuts are also common threaded fasteners types and have drive portions that are not compatible with typical hex socket tools. Line workers in the electric power distribution industry often encounter threaded fasteners having hexagonal and/or square shaped drive portions of various sizes and also often need to utilize hot line clamps that include an eyebolt that must be torqued by the line worker to loosen and/or tighten the clamp. Accordingly, there is a known desire for a socket tool that will can apply torque to multiple sizes of hexagonal and/or square drive portions and also to the drive portion of an eyebolt, wing nut, and/or ring nut.

BRIEF SUMMARY OF THE DISCLOSURE

In accordance with one feature of this disclosure, a multifunction socket tool is provided for transferring a drive torque from a driver component to a variety of threaded fasteners. The socket tool includes a first socket component and a second socket component. The first socket component extends along a longitudinal axis and includes: a first end opening in a first end and configured to receive a first size hexagonal shaped portion of a threaded fastener to transfer a torque from the first socket component to the first size hexagonal shaped portion; a first wall surrounding the first end opening; and a first pair of opposed slots extending through the first wall, each slot extending from the first end to a bottommost portion of the slot. The second socket component extends along a longitudinal axis and is mounted in the first socket component to translate along the longitudinal axis between a first position. The second socket component includes: a second end opening in the second end and configured to receive a second size hexagonal shaped portion of a threaded fastener to transfer a torque from the second socket component to the second size hexagonal shaped portion, the second size being smaller than the first size; a second wall surrounding the second end opening; and a second pair of opposed slots extending through the second wall, each slot of the second pair extending from the second end toward a bottommost portion of the slot. In the first position, the second end is either flush with the first end or extends outward beyond the first end. In the second position, the first end extends outward beyond the second end. The first socket component is engaged with the second socket component to transfer a torque to the second socket component with the second socket component in the first position.

According to one feature of this disclosure, a multifunction socket tool is provided for transferring a drive torque from a driver component to a variety of threaded fasteners.

The socket tool includes a first socket component and a second socket component. The first socket component includes: a first end and a driver end facing in opposite directions and spaced from each other along a longitudinal axis; a driver opening in the driver end and configured to receive a driver component to transfer a torque from the driver component to the first socket component; a first end opening in the first end and configured to receive a first size drive portion of a threaded fastener to transfer a torque from the first socket component to the first size drive portion; a first wall surrounding the first end opening; and a first pair of opposed slots extending through the first wall, each slot of the first pair extending from the first end toward the driver end. The second socket component is mounted in the first socket component to translate between a first position and a second position. The second socket component includes: a second end and a third end facing in opposite directions and spaced from each other along a longitudinal axis; a second end opening in the second end and configured to receive a second size drive portion of a threaded fastener to transfer a torque from the second socket component to the second size drive portion, the second size being smaller than the first size; a second wall surrounding the second end opening; and a second pair of opposed slots extending through the second wall, each slot of the second pair extending from the second end toward the third end of the second socket component. In the first position, the second end is either flush with the first end or extends outward beyond the first end. In the second position, the first end extends outward beyond the second end. The first socket component is engaged with the second socket component to transfer a torque to the second socket component with the second socket component in the first position.

In one feature, the second socket component is biased to the first position.

According to one feature, the multifunction socket tool further includes a compression spring engaged between the first and second socket components to bias the second socket component to the first position.

As one feature, each slot of the first pair of slots is defined by parallel side surfaces that extend from the first end toward the driver end, the side surfaces spaced from each other by a slot width W1. In a further feature, each slot of the first pair of slots is further defined by a concave bottom surface that extends between the parallel side surfaces. As a further feature, each of the side surfaces extends parallel to the longitudinal axis, and each of the first and second end openings has an interior wall shaped to form one of a 12-point socket, a 8-point socket, or a 6-point socket.

In one feature, each slot of the second pair of slots is defined by a concave surface that extends from the second end to a bottom most point of the slot. In a further feature, each slot of the second pair of slots has a maximum width WM defined by the distance between the intersections of the concave surface with the second end, with WM being greater than W1. As a further feature, each slot of the second pair of slots has a maximum depth DM extending parallel to the longitudinal axis between the second end and the bottommost point of the slot, and wherein the maximum depth DM is less than the maximum width WM.

According to one feature, the first end opening is configured to receive a hexagonal exterior shape of the first size and the second end opening is configured to receive a hexagonal exterior shape of the second size.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
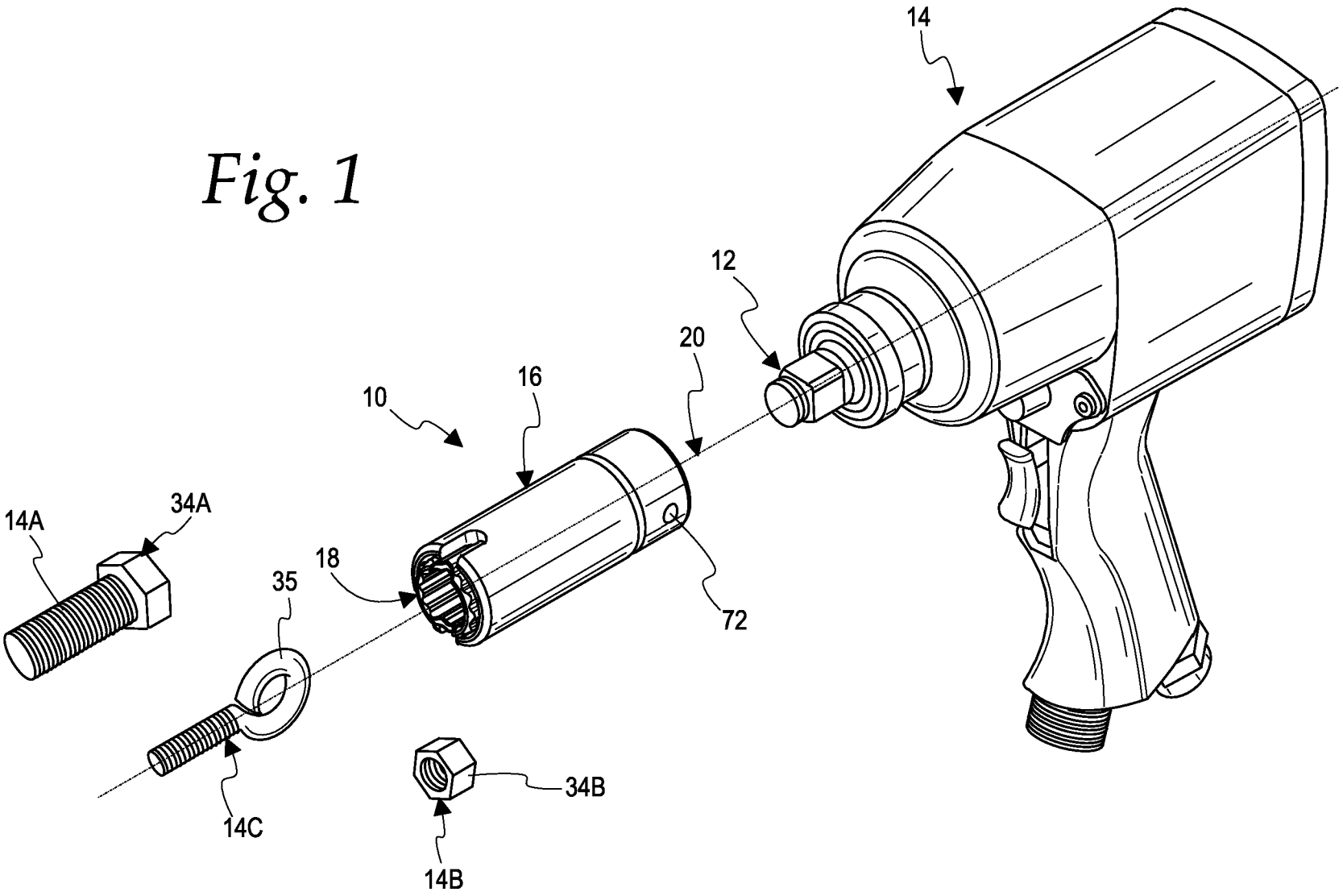
FIG. 1 is an exploded perspective view of a multifunction socket tool according to this disclosure in combination with a variety of threaded fasteners and a power driver for apply torque to the fasteners via the multifunction socket tool.

As best seen in FIG. 1, a multifunction socket tool 10 is shown for transferring a drive torque from a driver component 12 to a variety of threaded fasteners 14, such as for example, a hex head screw or bolt 14A, a hex nut 14B, an eyebolt 14C, a square nut, a square head screw or bolt, a wing nut, or a ring nut. One specific intended application for the illustrated and preferred embodiment of the socket tool 10 is the eyebolt 14C such as those commonly used in hot line clamps for the electric power distribution industry. The tool 10 includes a first socket component 16 and a second socket component 18 that both extend along a longitudinal axis 20. The second socket component 18 is mounted in the first socket component 16 to translate along the axis 20 relative to the first socket component 16 and is engage with the first socket component 16 to transfer a torque from the first socket component 16 to the second socket component 18.

In FIG. 1, the driver component 12 is driven by a pneumatic powered driver 15, but it should be understood that any driver commonly used to transfer torque to a socket tool can be used, such as for example, a battery powered driver, a ratchet wrench, a torque wrench, an impact driver, or a driver tool including a handle. Furthermore, while the drive component 12 is shown in the form of a square drive 12, any suitable shape and/or configuration, many of which are known, can be utilized according to this disclosure.

Figure 2:
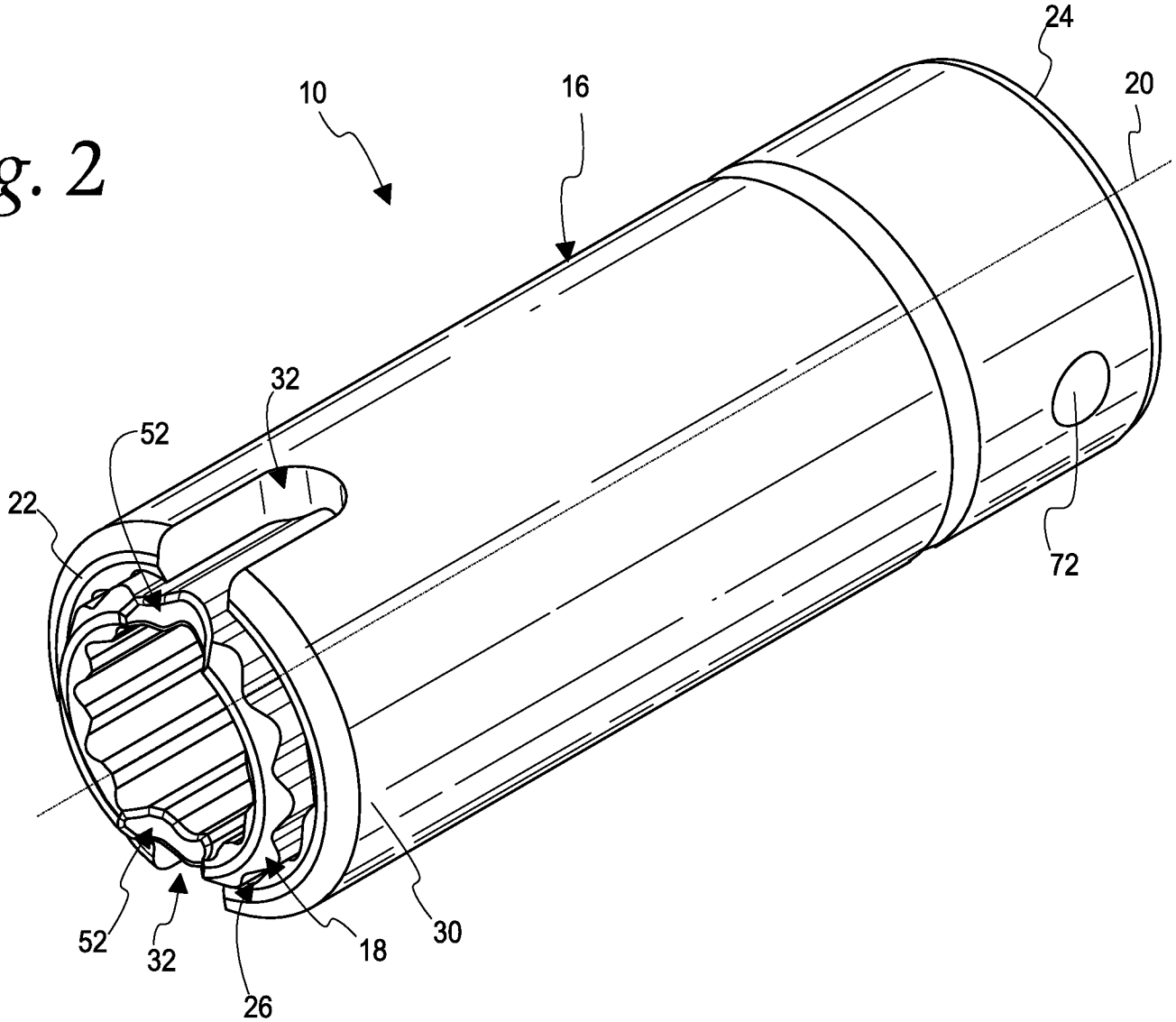
FIG. 2 is a perspective view of the multifunction socket tool of FIG. 1.
Figure 3:
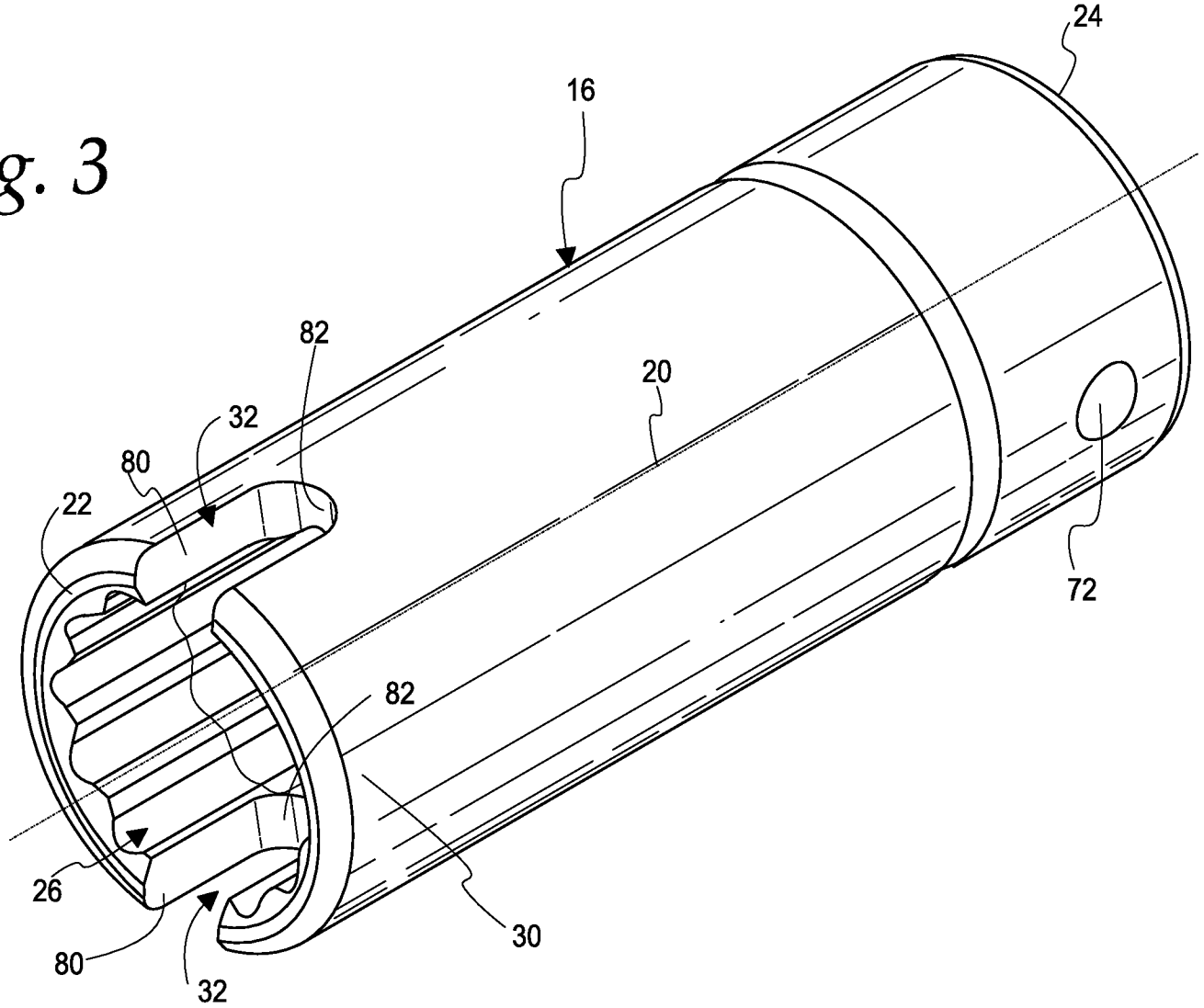
FIG. 3 is a perspective view of a socket component of the multifunction socket tool of FIGS. 1 and 2.
Figure 4:
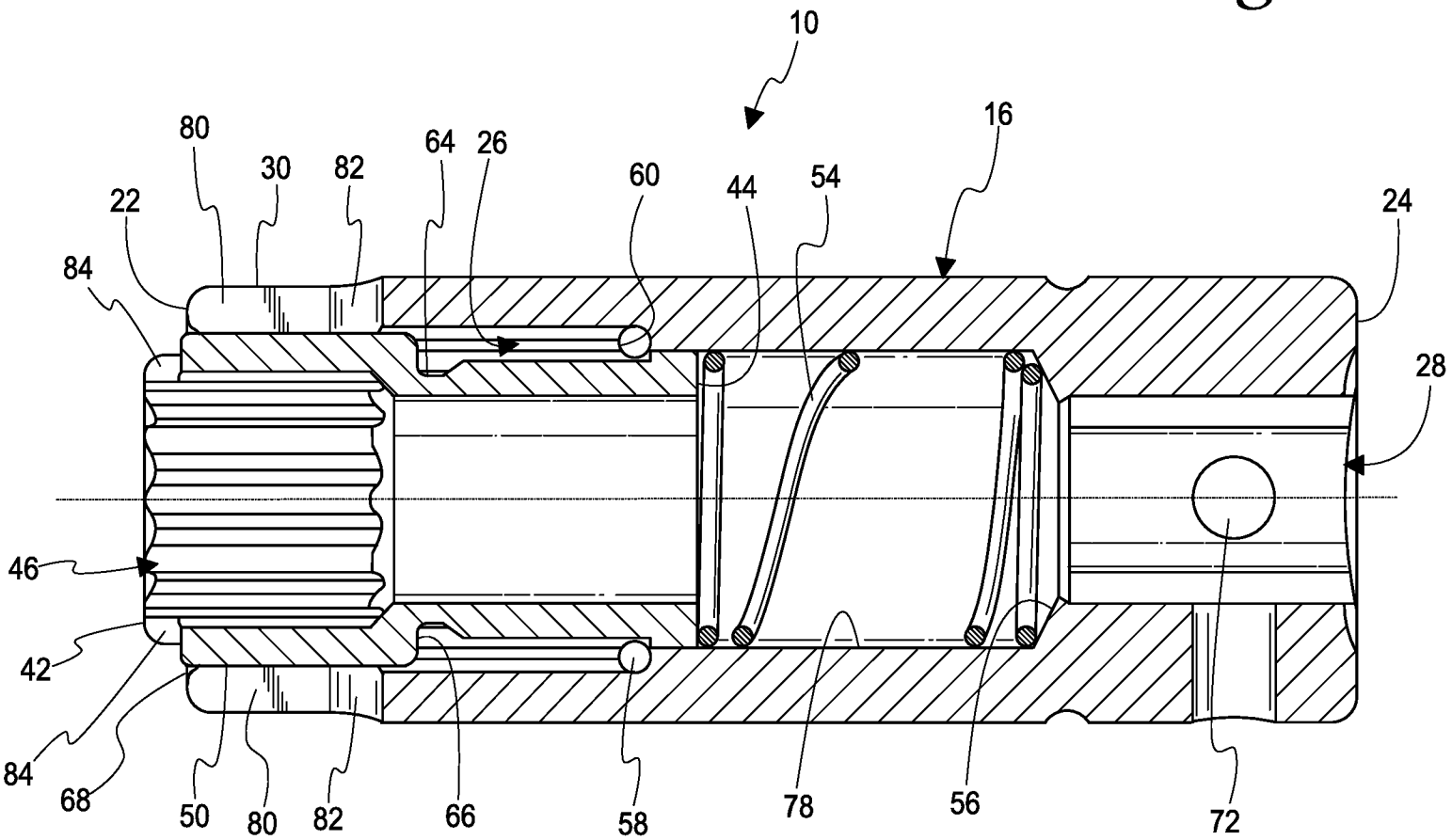
FIG. 4 is a longitudinal cross section view of the multifunction socket tool of FIGS. 1 and 2.

As best seen in FIGS. 2-4, the first socket component 16 includes a first end 22 and a driver end 24 facing in opposite directions and spaced from each other along the axis 20. The first socket component 16 also includes a first end opening 26 in the first end 22, a driver opening 28 in the driver end 24, a first wall 30 surrounding the first end opening 26, and a pair of opposed slots 32 extending through the first wall 30. The openings 26 and 28 and the wall 30 are centered on the axis 20. The driver opening 28 is configured to receive the driver component 12 to transfer torque from the driver component 12 to the first socket 16. In the illustrated and preferred, the opening 28 is in the form of a 4-point socket for receiving the illustrated square drive 12, but can be provided in any suitable shape or configuration, many of which are known, to receive any suitable shape or configuration for any specific driver component 12. The first end opening 26 is configured to receive a first size drive portion 34A of a threaded fastener 14 to transfer a torque from the first socket component 16 to the first size drive portion 34A. In the illustrated and preferred embodiment, the opening 26 is in the form of a 12-point socket as is commonly used to engage and drive a hex nut or hex head bolt, but can be provided in any suitable shape or configuration, many of which are known, to receive any suitable shape or configuration for any drive portion 34A of a threaded fastener 12. For example, the opening 26 could be in the form of a hexagonal shaped opening (6-point socket), a square shaped opening (4-point socket), or a 8-point socket. Each of the slots 32 extend from the first end 22 toward the second end 24 and together are configured to receive a drive portion 35 of the eyebolt 14C, or the drive portion of a ring nut or a wing nut, to transfer torque to the drive portion 35.

Figure 5:
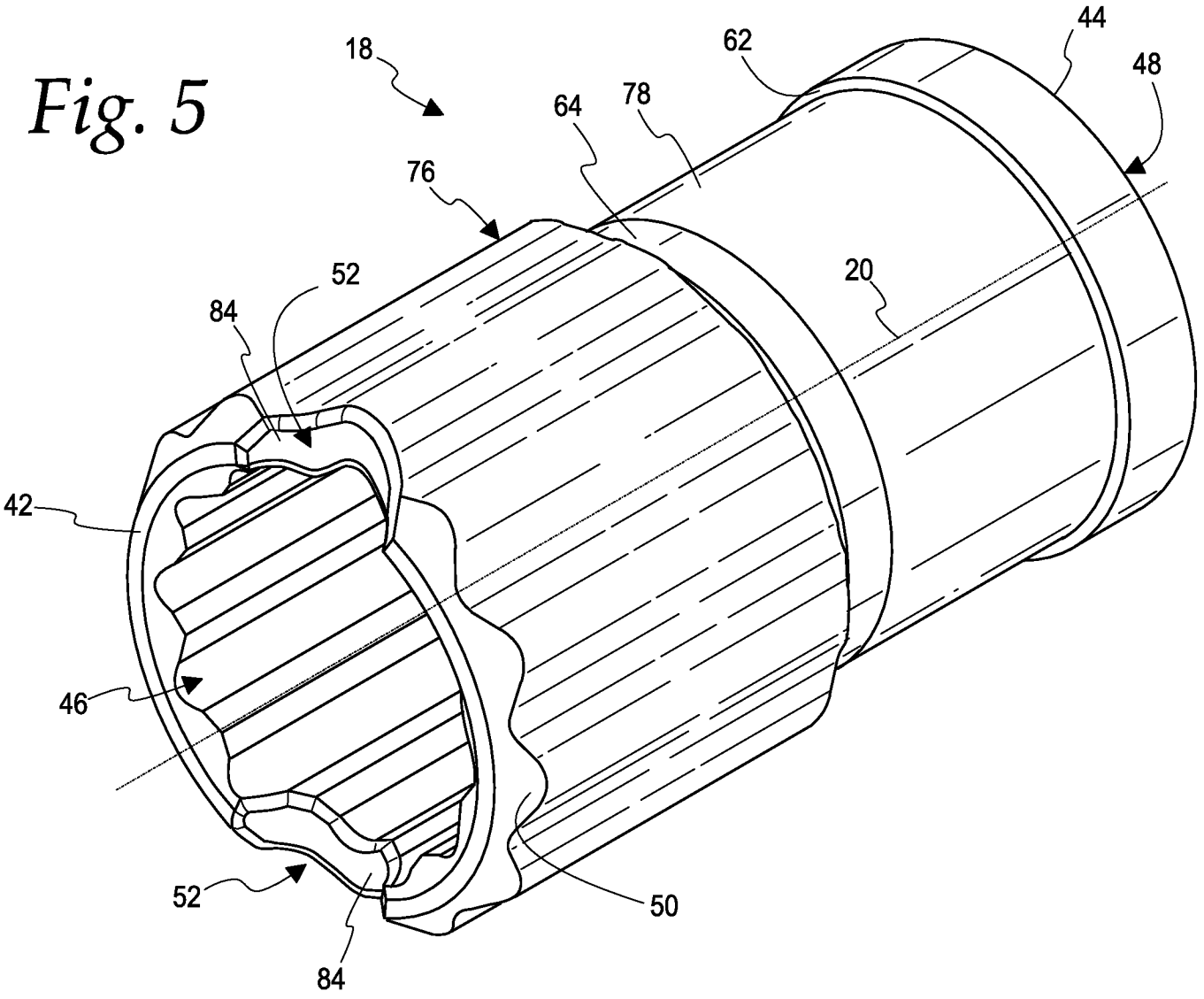
FIG. 5 is a perspective view of another socket component of the multifunction socket tool of FIGS. 1, 2, and 4.
Figure 6:
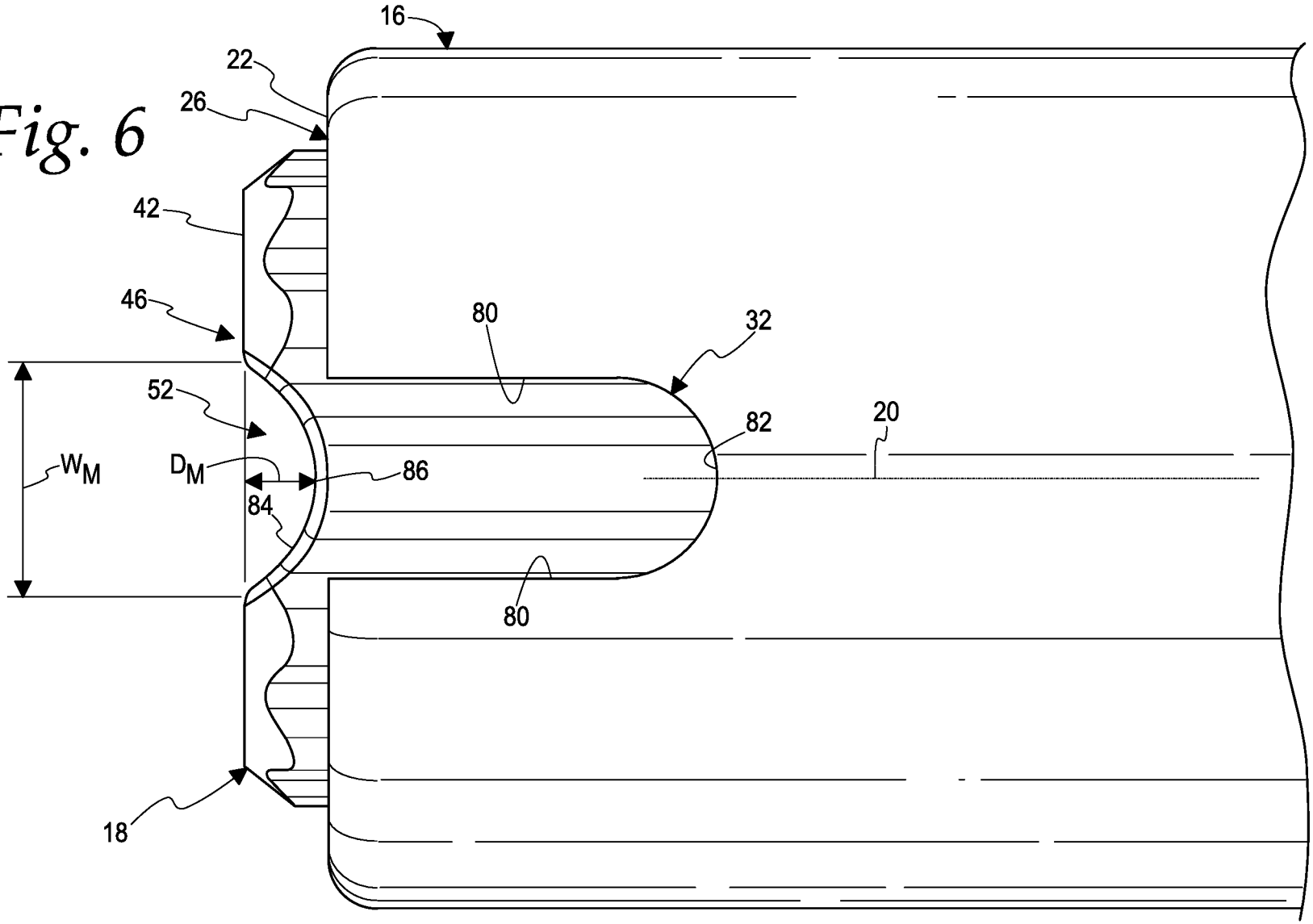
FIG. 6 is an enlarged partial side elevation view of the multifunction socket tool of FIGS. 1, 2, 4, and 5 showing the socket component of FIG. 5 in a first position.

As best seen in FIGS. 4 and 5, the second socket component 18 includes a second end 42 and an opposite end 44 facing in opposite directions and spaced from each other along the axis 20. The second socket component 16 also includes a second end opening 46 in the second end 44, an opening 48 in the end 44, a second wall 50 surrounding the second end opening 46, and a pair of opposed slots 52 extending through the second wall 40 and circumferentially aligned with the pair of opposed slots 32. The openings 46 and 48 and the wall 50 are centered on the axis 20. The second end opening 46 is configured to receive a second size drive portion 34B of a threaded fastener 14 to transfer a torque from the second socket component 18 to the second size drive portion 34B, with the second size drive portion 34B being smaller than the first size drive portion 34A. In the illustrated and preferred embodiment, the opening 46 is in the form of a 12-point socket as is commonly used to engage and drive a hex nut or hex head bolt, but can be provided in any suitable shape or configuration, many of which are known, to receive any suitable shape or configuration for any drive portion 34B of a threaded fastener 12, such as for example, a hexagonal shaped opening (6-point socket), a square shaped opening (4-point socket), or a 8-point socket. Each of the slots 52 extend from the first end 42 toward the second end 44 and together are configured to receive part of the drive portion 35 of the eyebolt 14C, or the drive portion of a ring nut or a wing nut, to align the slots 32 with the drive portion 35.

Figure 7:
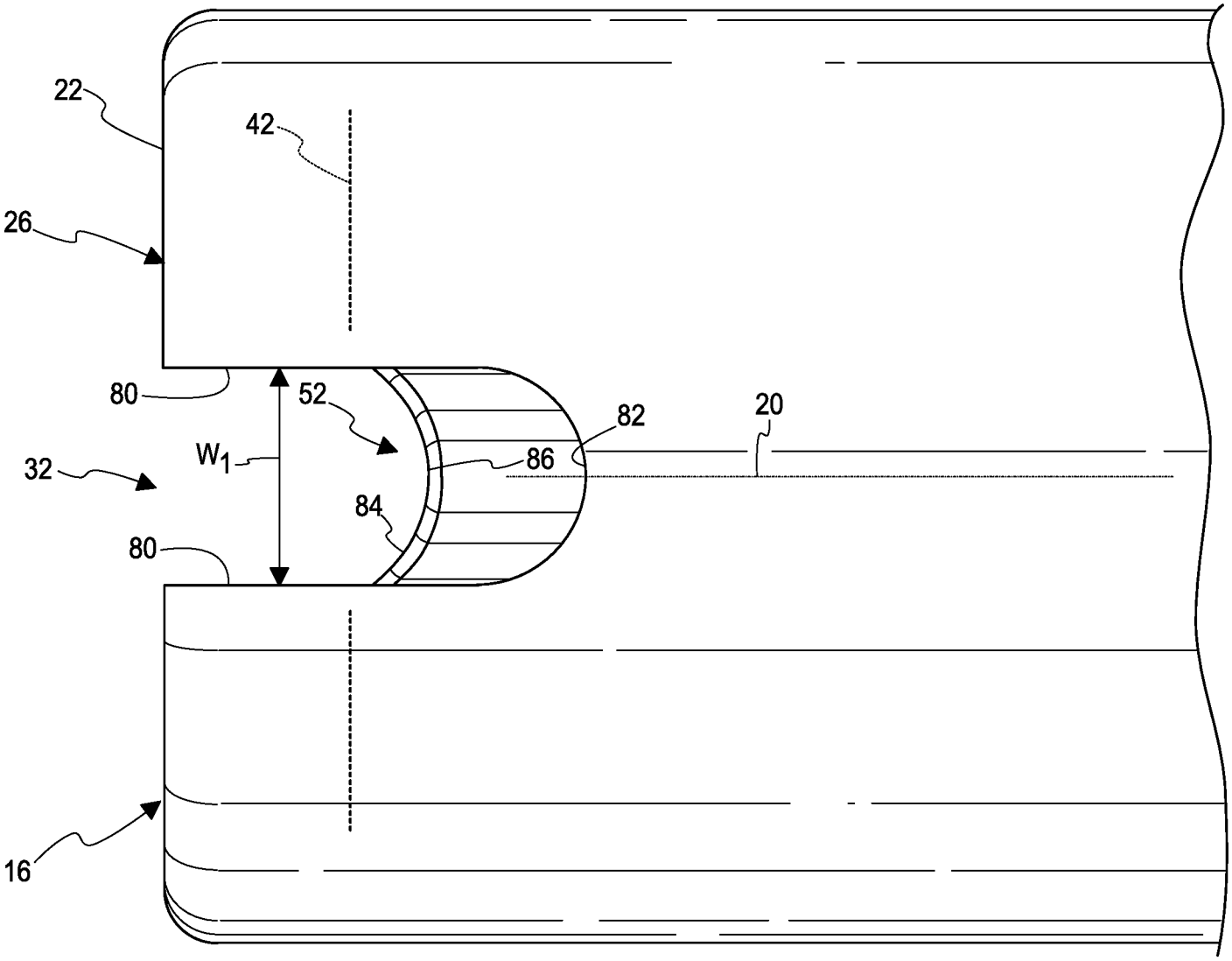
FIG. 7 is an enlarged partial side elevation view of the multifunction socket tool of FIGS. 1, 2, and 4-6 showing the socket component of FIG. 5 in a second position.
Figure 8:
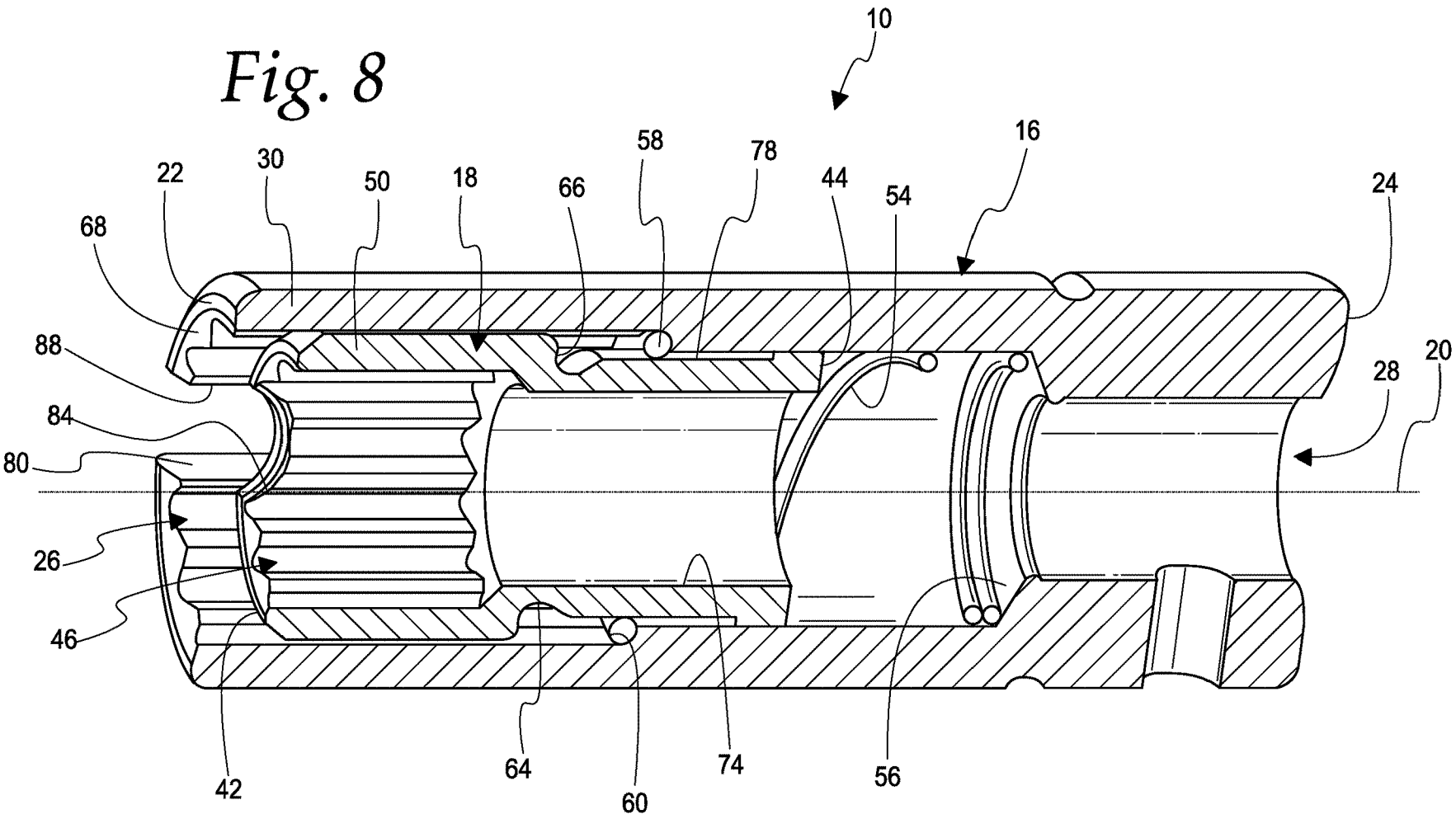
FIG. 8 is an enlarged perspective section view of the multifunction socket tool of FIGS. 1, 2, and 4-7 showing the socket component of FIG. 5 in the second position.
Figure 10:
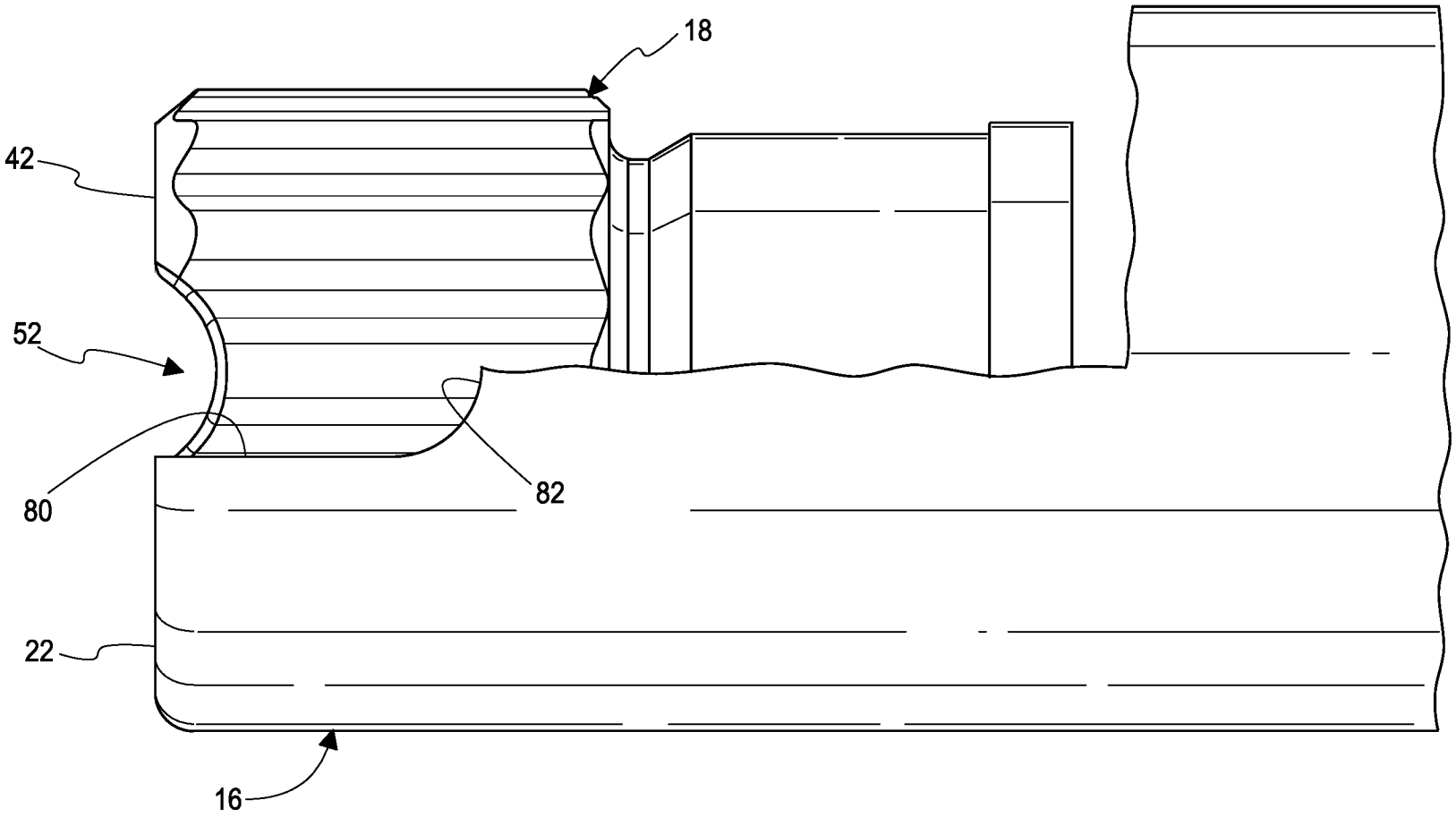
FIG. 10 is a view similar to FIG. 6, but with portions of one of the socket components broken away to illustrate an alternate embodiment wherein the ends of the socket components are flush in the first position.

The second socket component 18 is mounted in the first socket component 16 to translate along the axis 20 between a first position, such as shown in FIGS. 1, 2, 4, and 6 or as shown in FIG. 10, and a second position, shown in FIGS. 7 and 8. In the first position, the second end 42 is either flush with the first end 22 as shown in FIG. 10 or extends axially outwardly beyond the first end 22 as shown in FIGS. 1, 2, 4, and 6. In either case, the first position allows the second opening 46 to receive and engage a drive portion 34B of a threaded fastener 14 and/or to allows the slots 52 to align the slots 32 with the drive portion 35 of a threaded fastener 14C. In the second position, the first end 22 extends axially outwardly beyond the second end 42 to allow the first end opening 26 to receive and engage a drive portion 34A of a threaded fastener 14 and/or to allow the slots 32 to receive and engage the drive portion 35 of a threaded fastener 14C. As best seen in FIG. 4, in the illustrated and preferred embodiment, the second socket component 18 is biased to the first position by a helical compression spring 54 engaged between the first and second socket components 16 and 18. The spring 54 is located in the first opening 26 and is abutted against the end 44 of the second socket component 18 and an annular shoulder 56 located in the opening 26.

As best seen in FIGS. 4 and 8, the second socket component 18 and the spring 54 are retained in the first socket component 16 by a snap ring 58 secured in an annular groove 60 formed in the opening 26. The snap ring 58 abuts a radially outwardly extending annular shoulder 62 on second socket component 18 to limit axial movement of second socket component 18 in the axial direction away from the first socket component 16 and to locate the second socket component 18 in the first position.

The second socket component 18 includes an annular groove 64 that allows assembly of the snap ring 58 into the first socket component 16. In this regard, for assembly of the second socket component 18 into the first socket component 16, the snap ring 58 is first placed around the second socket component 18 abutting an annular shoulder 66 on the second socket component 18 adjacent the groove 64. The second socket component 18 is then inserted into the opening 26, with the snap ring 58 being radially compressed into the groove 64 by a lead-in chamfer 68 in the opening 26. The second socket component 18 is forced into the opening 26 until the shoulder 66 forces the snap ring 58 into axial alignment with the groove 60, which then allows the snap ring 58 to expand into the groove 60 to be axially secured thereby. In the illustrated embodiment, the snap ring 58 is provided in the form of a length cylindrical wire that includes been permanently deformed in to a circular shape, with the wire being made from a suitably resilient material, such as a suitable spring steel.

Figure 9:
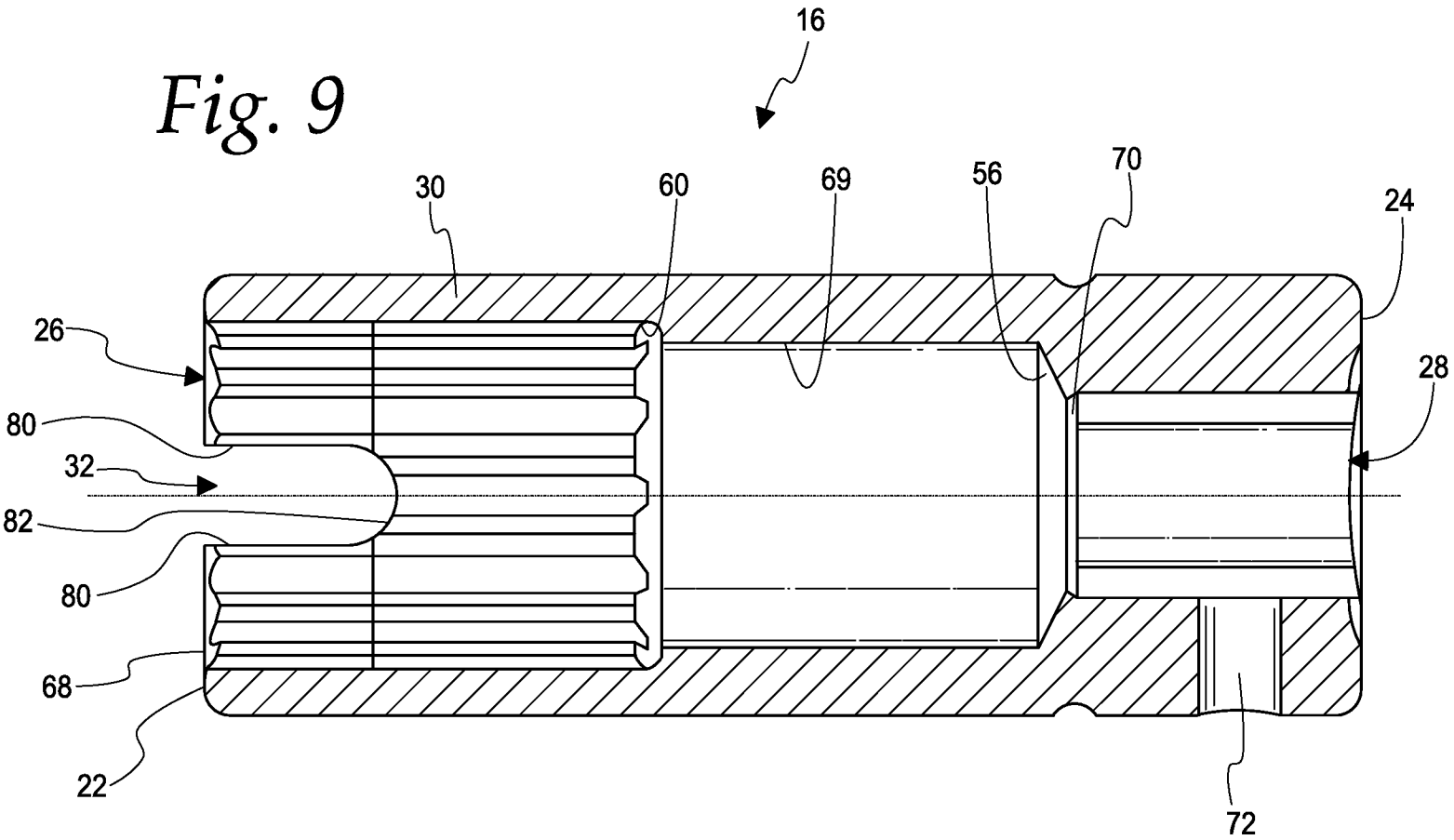
FIG. 9 is a longitudinal cross section view of the socket component of FIG. 3.

As best seen in FIG. 9, in the illustrated embodiment, the 12-point socket profile in the opening 26 extends from the end 22 to the groove 60, with the opening 26 including a cylindrical shape portion 69 from the groove 60 to the annular shoulder 56, which in the illustrated embodiment is shown as having a frustoconical shape. Similarly, the 4-point socket profile of the opening 28 extends from the end 24 to a cylindrical shaped portion 70 of the opening 28. The opening 28 of the illustrated embodiment includes a transverse bore 72 that is configured to receive a detent provided on the drive component 12 to releasably retain the tool 10 on the drive component 12.

As best seen in FIGS. 4 and 8, in the illustrated embodiment, the 12-point profile in the opening 46 extends from the end 42 to an inwardly facing, cylindrical surface 74 that continues to the end 44. Additionally, as best seen in FIG. 5, the second socket component 18 includes an outwardly facing, torque transfer feature 76. In the illustrated embodiment, the torque transfer feature 76 is provided in the form of an outwardly facing 12-point profile that is slidably engaged with the inwardly facing 12-point profile in the opening 26. This engagement allows the second socket component 18 to translate between the first and second positions while also allowing the first socket component 16 to transfer a torque to the second socket component in the first and second positions and in any intermediate position between the first and second positions. In the illustrated embodiment, the second socket component 18 also includes an outwardly facing, cylindrical surface 78 that extends from the groove 64 to the shoulder 62.

Turning now in more detail to the slots 32 and 52, the slots 32 and 52 are configured to increase the functionality of the socket tool 10 by enabling the socket tool 10 to easily engage and transfer torque via the slots 32 to a threaded fastener have a winged or ring shaped drive portion, such as the drive portion 35 of the eyebolt 14C, a wing shaped drive portion of a wing nut, or a ring shaped portion of a ring nut. In the illustrated and preferred embodiment, each slot 32 of the first pair of slots 32 is defined by a pair of parallel side surfaces 80 and a concave bottom surface 82 that extends between the parallel side surfaces 80. The side surfaces 80 extend parallel to the longitudinal axis 20 from the first end 22 toward the driver end 24 and are spaced from each other by a slot width $W_1$. Each slot of the second pair of slots 52 is preferably configured to allow the slots 52 to engage the drive portion 35 of the fastener 14C to align the slots 32 for engagement with the drive portion 35 as the second socket component 18 moves from the first position to the second position, but so that the slots 52 do not transfer torque, or any significant amount of torque, to the drive portion 35. This is extremely helpful because in the first position, the second end 42 of the second socket component 18 is either flush with the first end 22 of the first socket component 16 or extends outwardly from the end 22 of the first socket component 16, which prevents the slots 32 from engaging the drive portion 35 of the eyebolt 14C until the second socket component 18 is moved inwardly from the first position. To achieve this desired functionality in the illustrated embodiment, each of the slots 52 is defined by a concave surface 84 that extends from the second end 42 to a bottom most point 86 of the slot 52. Each slot 52 includes a maximum width $W_M$ defined by the distance between the intersections of the concave surface 84 with the second end 42, with $W_M$ being greater than $W_1$. Each slot 52 includes a maximum depth $D_M$ extending parallel to the longitudinal axis 20 between the second end 22 and the bottommost point 86 of the slot 52, with the maximum depth $D_M$ being less than the maximum width $W_M$.

In the illustrated embodiment, each of the socket components 16 and 18 is made from a single, unitary piece of material, which will typically be a suitable metallic material, such as a suitable hardened steel commonly employed for socket tools.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the multifunction socket tool 10 are shown in the figures, it should be understood that this disclosure anticipates variations in the specific details of each of the disclosed components and features of the multifunction socket tool 10 and that no limitation to a specific form, configuration, or detail is intended unless expressly and specifically recited in an appended claim.

For example, while specific and preferred forms have been shown for the shapes or the first and second opening 26 and 46, other shapes that are suitable to transfer torque to a drive portion of a threaded fastener are possible and may be desirable depending upon the specific shape/configuration of the drive portion. As another example, while specific shapes and configuration have been shown for the slots 32 and 52 other shapes and configurations may be desirable. For example, while parallel side surfaces 80 are preferred for most applications in connection with an eyebolt of a hot line clamp, slots 32 having non-parallel side surfaces 80 and/or side surfaces 80 that do not extend parallel to the longitudinal axis 20 may be desirable depending upon the requirements of any specific application. As another example, while the arcuate shape of the concave surface 84 is preferred, in some application it may be desirable for the concave surface 84 to have a non-arcuate shape, such as a V-shape. Similarly, while it is preferred that the bottom surface 82 have an arcuate shape, other shapes, such as a V-shape or transverse planar shape may be desirable for some applications. As yet another example, while the torque transfer feature 76 is shown in the form of an outwardly facing 12-point profile that generally conforms to the illustrated inwardly facing 12-point profile of the opening 26, other profiles may be desirable depending upon each application. For example, the torque transfer feature 76 could have been provide in the form of a profile having fewer than 12 "points" that would be compatible with the illustrated 12-point profile of the opening 26. As another example, if the opening 26 had a 6-point profile, the torque transfer feature 76 could be provided in the form of an outwardly facing 6-point profile, or a profile having less than 6 "points" that would still be compatible with the 6-point profile of the opening 26. As yet another example, the torque transfer feature could be slidably engaged with a feature other than the 12-point profile of the opening 26 that would still provide a transfer of torque from the first socket component 16 to the second socket component 18 with the second socket component 18 in the first position. As yet another example, while it is preferred that the second socket component be biased to the first position, in some applications it may be desirable for the second socket component to be releasable retained in the first position, and movable to the second position in response to a force that overcomes the retention or via the actuation of a retaining feature. In a further example, while it is preferred that the snap ring 58 be secured in the groove 60 to engage the shoulder 62 for retaining the second component 18 in the first component 16 and for locating the second component 18 in the first position, other configurations may be desirable depending upon the specific application. For example, the snap ring 58 could be retained in a groove formed on the second socket component 18 that would be configured to all the snap ring 58 to be compressed while being assembled past an annular shoulder in the opening 26 and then retained for engagement with the shoulder after assembly to retain the second socket component 18 in the first socket component 16 and to locate the second socket component in the first position. In a further example, while the snap ring 58 is shown as having a circular shaped transverse cross-section, other shapes or possible, including for example, a rectangular or square shape. Further in this regard, some cross-sectional shapes and/or sizes of the snap ring 58 may allow for allow for assembly of the component 18 into the component 16 without the use of a groove 64 on the component 18 because the surface 78 will allow sufficient clearance for the snap ring 58 to be inserted into the opening 26 when the snap ring 58 is compressed. As a further example, structures other than snap rings and annular shoulders could be used to retain the second component 18 in the first component 16 and/or to locate the second component 18 in the first position. Accordingly, it should clearly be understood that no limitation to a specific structure, form or configuration is intended unless expressly recited in an appended claim.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "including," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

What is claimed is:

1. A multifunction socket tool for transferring a drive torque from a driver component to a variety of threaded fasteners, the socket tool comprising:

a first socket component including:

a first end and a driver end facing in opposite directions and spaced from each other along a longitudinal axis, a driver opening in the driver end and configured to receive a driver component to transfer a torque from the driver component to the first socket component, a first end opening in the first end and configured to receive a first size drive portion of a threaded fastener to transfer a torque from the first socket component to the first size drive portion, a first wall surrounding the first end opening, and a first pair of opposed slots extending through the first wall, each slot of the first pair extending from the first end toward the driver end; and a second socket mounted in the first socket component to translate between a first position and a second position, the second socket component including:

a second end and a third end facing in opposite directions and spaced from each other along a longitudinal axis, a second end opening in the second end and configured to receive a second size drive portion of a threaded fastener to transfer a torque from the second socket component to the second size drive portion, the second size being smaller than the first size, a second wall surrounding the second end opening, and a second pair of opposed slots extending through the second wall, each slot of the second pair extending from the second end toward the third end of the second socket component; and wherein in the first position, the second end is one of:

flush with the first end, or extends outward beyond the first end, in the second position, the first end extends outward beyond the second end, and the first socket component is engaged with the second socket component to transfer a torque to the second socket component with the second socket component in the first position.

2. The multifunction socket tool of claim 1 wherein the second socket component is biased to the first position.

3. The multifunction socket tool of claim 1 further comprising a compression spring engaged between the first and second socket components to bias the second socket component to the first position.

4. The multifunction socket tool of claim 1 wherein each slot of the first pair of slots is defined by parallel side surfaces that extend from the first end toward the driver end, the side surfaces spaced from each other by a slot width $W_1$.

5. The multifunction socket tool of claim 4 wherein each slot of the first pair of slots is further defined by a concave bottom surface that extends between the parallel side surfaces.

6. The multifunction socket tool of claim 4 wherein each slot of the second pair of slots is defined by a concave surface that extends from the second end to a bottom most point of the slot.

7. The multifunction socket tool of claim 6 wherein each slot of the second pair of slots includes a maximum width $W_M$ defined by the distance between the intersections of the concave surface with the second end, with $W_M$ being greater than $W_1$.

8. The multifunction socket tool of claim 7 wherein each slot of the second pair of slots includes a maximum depth $D_M$ extending parallel to the longitudinal axis between the second end and the bottommost point of the slot, and wherein the maximum depth $D_M$ is less than the maximum width $W_M$.

9. The multifunction socket tool of claim 4 wherein each of the side surfaces extends parallel to the longitudinal axis, and each of the first and second end openings includes an interior wall shaped to form one of a 12-point socket, a 8-point socket, or a 6-point socket.

10. The multifunction socket tool of claim 1 wherein each slot of the second pair of slots is defined by a concave surface that extends from the second end to a bottom most point of the slot.

11. The multifunction socket tool of claim 1 wherein the first end opening is configured to receive a hexagonal exterior shape of the first size, and the second end opening is configured to receive a hexagonal exterior shape of the second size.

12. A multifunction socket tool for transferring a drive torque from a driver component to a variety of threaded fasteners, the socket tool comprising:

a first socket component extending along a longitudinal axis and including:

a first end opening in a first end and configured to receive a first size hexagonal shaped portion of a threaded fastener to transfer a torque from the first socket component to the first size hexagonal shaped portion, a first wall surrounding the first end opening, and a first pair of opposed slots extending through the first wall, each slot extending from the first end to a bottommost portion of the slot; and a second socket component extending along a longitudinal axis and mounted in the first socket component to translate along the longitudinal axis between a first position and a second position, the second socket component including a second end opening in the second end and configured to receive a second size hexagonal shaped portion of a threaded fastener to transfer a torque from the second socket component to the second size hexagonal shaped portion, the second size being smaller than the first size, a second wall surrounding the second end opening, and a second pair of opposed slots extending through the second wall, each slot of the second pair extending from the second end toward a bottommost portion of the slot; and wherein in the first position, the second end is one of:

flush with the first end, or extends outward beyond the first end, in the second position, the first end extends outward beyond the second end, and the first socket component is engaged with the second socket component to transfer a torque to the second socket component with the second socket component in the first position.

13. The multifunction socket tool of claim 12 wherein the second socket component is biased to the first position.

14. The multifunction socket tool of claim 12 further comprising a compression spring engaged between the first and second socket components to bias the second socket component to the first position.

15. The multifunction socket tool of claim 12 wherein each slot of the first pair of slots is defined by parallel side surfaces that extend from the first end toward the bottommost portion of the slot, the side surfaces spaced from each other by a slot width $W_1$.

16. The multifunction socket tool of claim 15 wherein:

each slot of the first pair of slots is further defined by a concave bottom surface that extends between the parallel side surfaces;

each of the parallel side surfaces extends parallel to the longitudinal axis; and and each of the first and second end openings includes an interior wall shaped to form one of a 12-point socket or a 6-point socket.

17. The multifunction socket tool of claim 15 wherein each slot of the second pair of slots is defined by a concave surface that extends from the second end to a bottom most point of the slot.

18. The multifunction socket tool of claim 17 wherein each slot of the second pair of slots includes a maximum width $W_M$ defined by the distance between the intersections of the concave surface with the second end, with $W_M$ being greater than $W_1$.

19. The multifunction socket tool of claim 18 wherein each slot of the second pair of slots includes a maximum depth $D_M$ extending parallel to the longitudinal axis between the second end and the bottommost point of the slot, and wherein the maximum depth $D_M$ is less than the maximum width $W_M$.

20. The multifunction socket tool of claim 12 wherein each slot of the second pair of slots is defined by a concave surface that extends from the second end to a bottom most point of the slot.

* * * * *